US006679167B2

(12) United States Patent
Uchiyama

(10) Patent No.: US 6,679,167 B2
(45) Date of Patent: Jan. 20, 2004

(54) IMAGE GENERATING METHOD AND APPARATUS

(75) Inventor: Koichi Uchiyama, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 10/382,513

(22) Filed: Mar. 7, 2003

(65) Prior Publication Data

US 2003/0177920 A1 Sep. 25, 2003

(30) Foreign Application Priority Data

Mar. 22, 2002 (JP) ..... P2002-081676

(51) Int. Cl.[7] ..... B41M 1/12

(52) U.S. Cl. ..... 101/129; 101/116; 101/128.21; 101/128.4; 345/84

(58) Field of Search ..... 101/114, 116, 101/117, 118, 119, 120, 123, 128.21, 128.4, 129; 345/84, 85, 86; 359/296, 297; 399/130, 158

(56) References Cited

U.S. PATENT DOCUMENTS 5,937,750 A * 8/1999 Takeda ..... 101/116
6,411,316 B1 * 6/2002 Shigehiro et al. ..... 347/112
2002/0054423 A1 * 5/2002 Kurematsu ..... 359/291
2002/0135861 A1 * 9/2002 Nakao et al. ..... 359/296
2003/0043092 A1 * 3/2003 Uchiyama ..... 345/85
2003/0138266 A1 * 7/2003 Ikegawa ..... 399/130

FOREIGN PATENT DOCUMENTS

GB 2083409 A * 3/1982 ..... B41C/1/14
JP 357155549 A * 9/1982

* cited by examiner

*Primary Examiner*—Ren Yan
(74) *Attorney, Agent, or Firm*—Nath & Associates PLLC; Gary M. Nath; Marvin C. Berkowitz

(57) ABSTRACT

An image display medium 1 includes a film body 2 having a number of microscopic film pieces 2*a*. The film body 2 is sandwiched between a supporting member 3 having receiving spaces 5 and a cover member 4. The image display medium 1 is brought into contact with a rotary drum 26 of an image generating apparatus. Corresponding to a perforated image in a stencil sheet 101 attached to the rotary drum 26, the respective microscopic film pieces 2*a* of the film body 2 are selectively absorbed to the cover member 4 or partitions 5*a* of the supporting member 3.

8 Claims, 10 Drawing Sheets

IMAGE GENERATING METHOD AND APPARATUS

BACKGROUND OF THE INVENTION

1. Field of the Invention

The present invention relates to image generating method and apparatus for generating a desired display image on an image display medium. Particularly, it relates to image generating method and apparatus for generating a display image on an image display medium capable of repetitive rewriting thereby providing availability like a paper.

2. Description of the Related Art

With the progress of information society in recent years, there have been increased the chances of reading computerized information in the form of a display image on a display and also in the form of a printed paper provided by printing a display image on a paper. In this situation, it has been required that the image on the display is easily viewable like the image on a printed paper, easily portable like a printed paper and usable in spite of being folded. Further, it has been required that the printed paper is capable of repetitive rewriting like the display and also representing an animation.

In order to meet these requirements, a new media having respective merits of the display and the printed paper, such as electronic paper and paper-like display, has been proposed in recent years and therefore, the development of technology is promoted toward the practical use of new media actively.

As for the technology for realizing the electronic paper and the paper-like display, there are studied various technology, for example, image displaying technique to make use of electrophoretic effect, image displaying technique to make use of the rotations of colored particles called "twist balls", technique to change a display image in reversibility by the thermal rewritable method, technique to apply a liquid display method, technique to display an image by moving colored particles in particles, etc.

Focusing attention on method of generating a display image, the above-mentioned electronic paper and paper-like display are divided broadly into two types. One is a type that writing means for a display image is integrated with a medium for displaying an image, which will be referred "image display medium" hereinafter. The other one is a type that the writing means for a display image is separated from the image display medium to form an image generating apparatus. In this case, the display image is formed in the image display medium by the image generating apparatus.

The former type that the writing means is integrated with the image display medium has the advantage of possibility to rewrite the display image each time. However, the image display medium has a complicated structure to exhibit the limit for low-cost. Therefore, it is supposed that it is difficult to spread this type of medium as new media in place of paper. To the contrary, the latter type that the writing means is separated from the image display medium has the advantage of simplifying the structure of the image display medium itself, which is effective in saving the manufacturing cost. Therefore, it is expected to realize the utilization of this medium in the form closer to paper.

In the latter type, however, the image generating apparatus (as the wiring means) is generally required to have a number of exclusive mechanisms in order to form an appropriate display image in the image display medium. This requirement is an obstacle to the realization of low-cost for the total system including the image generating apparatus.

Additionally, in the conventional technology, there is a tendency for a processing time to increase in forming the display image in the image display medium while using the image generating apparatus as the writing means. Therefore, a high-speed processing, such as printing operation of printed papers, has been unfulfilled in the present circumstances.

SUMMARY OF THE INVENTION

Under such a circumstance, it is therefore an object of the present invention to provide image generating method and apparatus that allow a desired display image to be formed in an image display medium used as an electronic paper or a paper-like display, by means of a low-cost system and that make possible to perform an operation to generate a display image in the image display medium at high speed.

The present invention provides an image generating method of generating a desired display image in a rewritable image display medium by transcribing a perforated image of a stencil sheet to the image display medium, the stencil sheet being attached to a rotary drum, the method comprising the steps of: preparing the image display medium including: a film body having a base and a number of microscopic film pieces connected with each other through the base, the microscopic film pieces having light-blocking effect and corresponding to respective pixels forming the desired display image; a supporting member having a main face formed to support the film body thereon, the supporting member being provided, on the side of the main face, with a number of receiving spaces defined by partitions, the receiving spaces corresponding to the microscopic film pieces respectively and also allowing the microscopic film pieces to be moved therein independently; and a cover member arranged on the main face of the supporting member while interposing the film body therebetween, the cover member having light-transmitting effect, and allowing the microscopic film pieces of the film body of the image display medium to be selectively absorbed to either the cover member or the partitions in accordance with the perforated image of the stencil sheet, thereby generating the display image in the image display medium.

The image display medium used in the above image generating method is an image display medium called "electronic paper" or "paper-like display". As the film body for this image display medium, it is possible to adopt an insulating film having light-blocking effect, for example. The numerous microscopic film pieces are provided by forming a number of C-shaped notches in the insulating film having a desired size, etc. In the film, a film's portion (area) surrounded by each notch forms one microscopic film piece corresponding to a display pixel. A film's portion (area) between the adjoining microscopic film pieces forms the base of the film body.

On the main face of the supporting member, the film body is supported by the supporting member. The cover member having light-transmitting effect is arranged on the film body supported by the supporting member. Thus, the film body is sandwiched between the supporting member and the cover member.

On the side of the main face of the supporting member carrying the film body, the numerous receiving spaces are defined corresponding to the microscopic film pieces respectively. The receiving spaces allows the microscopic film pieces to be moved therein independently.

In the above-constructed image display medium, for example, by fixing respective electrical charges of the supporting member and the cover member (electret), the numerous microscopic film pieces of the film body are respectively absorbed to either the cover member or the partitions forming the receiving spaces due to electrostatic induction and further, such an absorbed condition is maintained. In the medium's portion where the corresponding microscopic film piece is absorbed to the cover member, light is blocked up by the microscopic film piece. While, in the medium's portion where the corresponding microscopic film piece is absorbed to the partition of the supporting member, light can pass through the film body and enter the receiving space. Therefore, it becomes possible to switch, for every microscopic film piece, between one state that the microscopic film piece is absorbed to the cover member to block up the light and another state that the microscopic film piece is absorbed to the partition of the supporting member to penetrate the light, selectively. That is, for every display pixel, it is possible to control blockade and transmission of light, allowing an image corresponding to this light control to be displayed.

In the image generating method of the invention, the microscopic film pieces of the film body are absorbed to either the cover member or the partitions selectively in accordance with the perforated image of the stencil sheet attached to the rotary drum. Consequently, the perforated image of the stencil sheet is transcribed to the image display medium, forming a desired display image.

In detail, it is carried out to make the stencil sheet attached to the rotary drum take an electrical charge so that the stencil sheet produces a contrast of charge corresponding to the perforated image. Further, it is carried out to make the microscopic film pieces of the film body move in accordance with the contrast of charge. Then, the microscopic film pieces are selectively absorbed to either the cover member or the partitions by electrostatic induction. Consequently, the image display medium has a display image formed to correspond to the perforated image of the stencil sheet.

In order to allow the stencil sheet to have a contrast of charge in accordance with the perforated image, a paper where a thermosensitive film is laminated on a perforated carrier coated with conductive agents is suitable for the stencil paper. Alternatively, a paper where a thermosensitive film comes in close contact with a conductive film through a wax having conductivity is suitable for the stencil paper, as well. The stencil sheet is produced by forming a perforated image corresponding to the display image, in the thermosensitive film of the stencil paper. Subsequently, by attaching the resulting the stencil sheet to the rotary drum and further electrizing the stencil sheet, the contrast of charge is produced to correspond to the perforated image in the stencil sheet.

In order to transcribe the perforated image of the stencil sheet to the image display medium thereby generating a desired display image therein, it may be carried out to emit or suck air through the rotary drum having the stencil sheet attached thereto. Then, a pressure of the above air acts on the image display medium through the stencil sheet. In this case, the cover member is formed to have air permeability. Owing to the pressure of the air, the microscopic film pieces of the film body are moved in accordance with the perforated image of the stencil sheet and selectively absorbed to either the cover member or the partitions defining the receiving spaces. In this way, it is possible to produce a desired display image corresponding to the perforated image of the stencil sheet, in the image display medium.

In addition, the present invention provides an image generating apparatus for generating a desired display image in a rewritable image display medium. The image generating apparatus is formed by medium loading means for transferring an image display medium and image generating means for generating the display image in the image display medium transferred by the medium loading means. In the image generating apparatus, the image display medium to be transferred by the medium loading means includes a film body having a base and a number of microscopic film pieces connected with each other through the base, the microscopic film pieces having light-blocking effect and corresponding to respective pixels forming the desired display image, a supporting member having a main face formed to support the film body thereon, the supporting member being provided, on the side of the main face, with a number of receiving spaces defined by partitions, the receiving spaces corresponding to the microscopic film pieces respectively and also allowing the microscopic film pieces to be moved therein independently, and a cover member arranged on the main face of the supporting member while interposing the film body therebetween, the cover member having light-transmitting effect.

Further, in the image generating apparatus, the image generating means includes a rotary drum having a stencil sheet attached thereto. Corresponding to a perforated image of the stencil sheet attached to the rotary drum, the microscopic film pieces of the film body of the image display medium are selectively absorbed to either the cover member or the partitions. In this way, since the perforated image of the stencil sheet on the rotary drum is transcribed to the image display medium, it becomes possible to generate a desired display image in the image display medium.

In detail, for example, the image generating means allows the stencil sheet attached to the rotary drum to take an electrical charge thereby making the stencil sheet produce a contrast of charge corresponding to the perforated image. Further, the image generating means allows the microscopic film pieces of the film body to move in accordance with the contrast of charge. Then, the microscopic film pieces are selectively absorbed to either the cover member or the partitions by electrostatic induction. Consequently, the image display medium has a display image formed to correspond to the perforated image of the stencil sheet.

Alternatively, the image generating means may be adapted so as to emit or suck air through the rotary drum and also adapted so as to make the microscopic film pieces of the film body move in accordance with the perforated image of the stencil sheet by making use of air pressure of the air through the rotary drum. In this case, the cover member is formed to have air permeability. Owing to the pressure of the air, the microscopic film pieces of the film body are moved in accordance with the perforated image of the stencil sheet and selectively absorbed to either the cover member or the partitions defining the receiving spaces by electrostatic induction. In this way, it is possible to produce a desired display image corresponding to the perforated image of the stencil sheet, in the image display medium.

These and other objects and features of the present invention will become more fully apparent from the following description and appended claims taken in conjunction with the accompany drawings.

BRIEF DESCRIPTION OF THE DRAWINGS

FIGS. 3A, 3B and 3C are respective views explaining an operating principle of the image display medium; in which FIG. 3A shows a state that a microscopic film piece of a film body is absorbed onto a partition of a supporting member; FIG. 3B shows a state that the microscopic film piece is moving in a receiving space defined in the supporting member and FIG. 3C shows a state that the microscopic film piece is absorbed onto a cover member;

DETAILED DESCRIPTION OF THE PREFERRED EMBODIMENT

Hereinafter, preferred embodiments of the present invention will be concretely described with reference to the drawings.

In the image generating system that the present invention is applied, a desired display image is generated on an image display medium utilized in the form of an electronic paper or a paper-like display, by an image generating apparatus on application of a stencil printing machine.

Re. Image Display Medium

First, the image display medium used in the image generating system on the application of the present invention will be described below.

Figure 1:
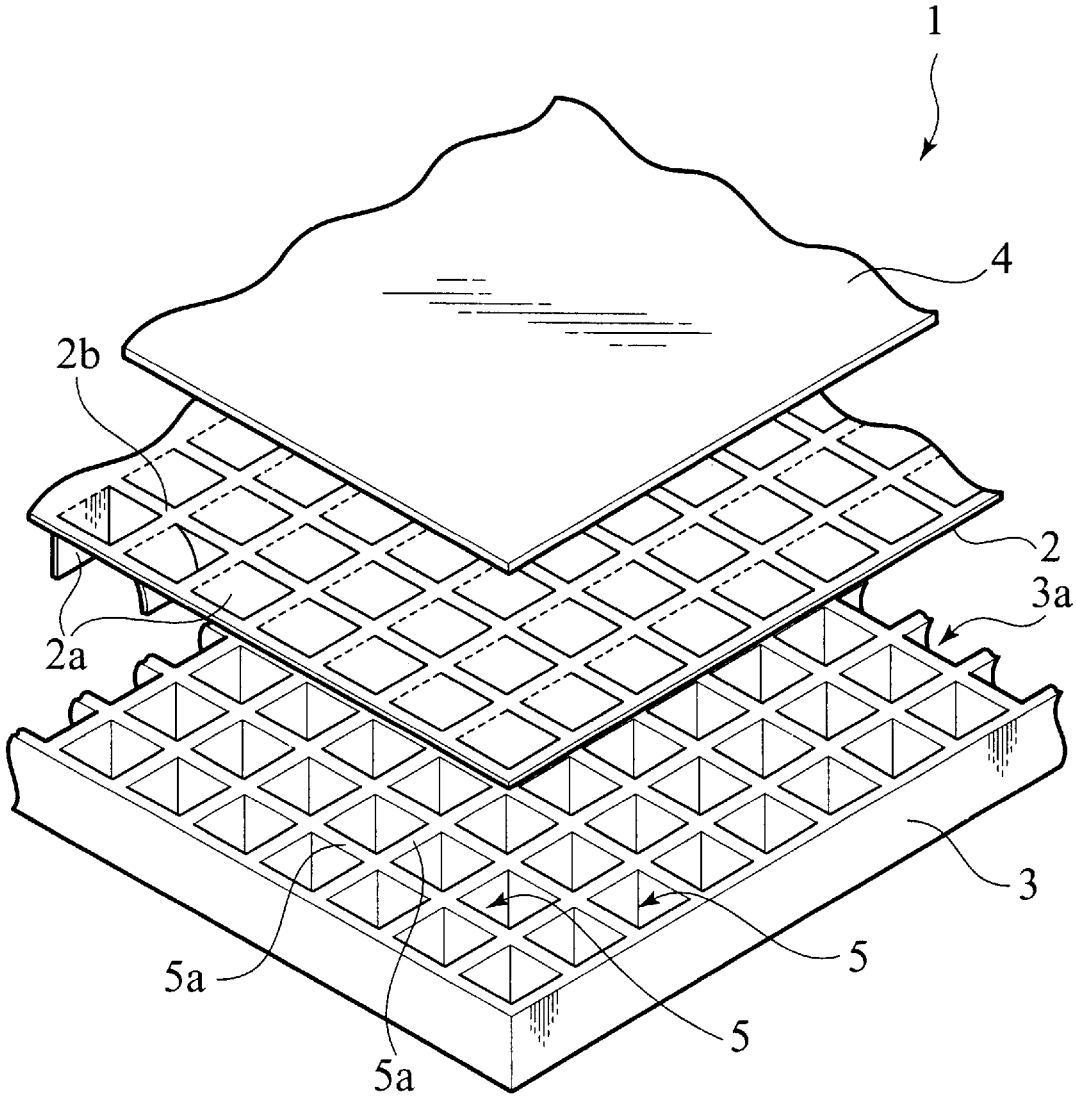
FIG. 1 is an exploded perspective view showing an enlarged part of an image display medium used in an image generating system on which the present invention is applied.
Figure 2:
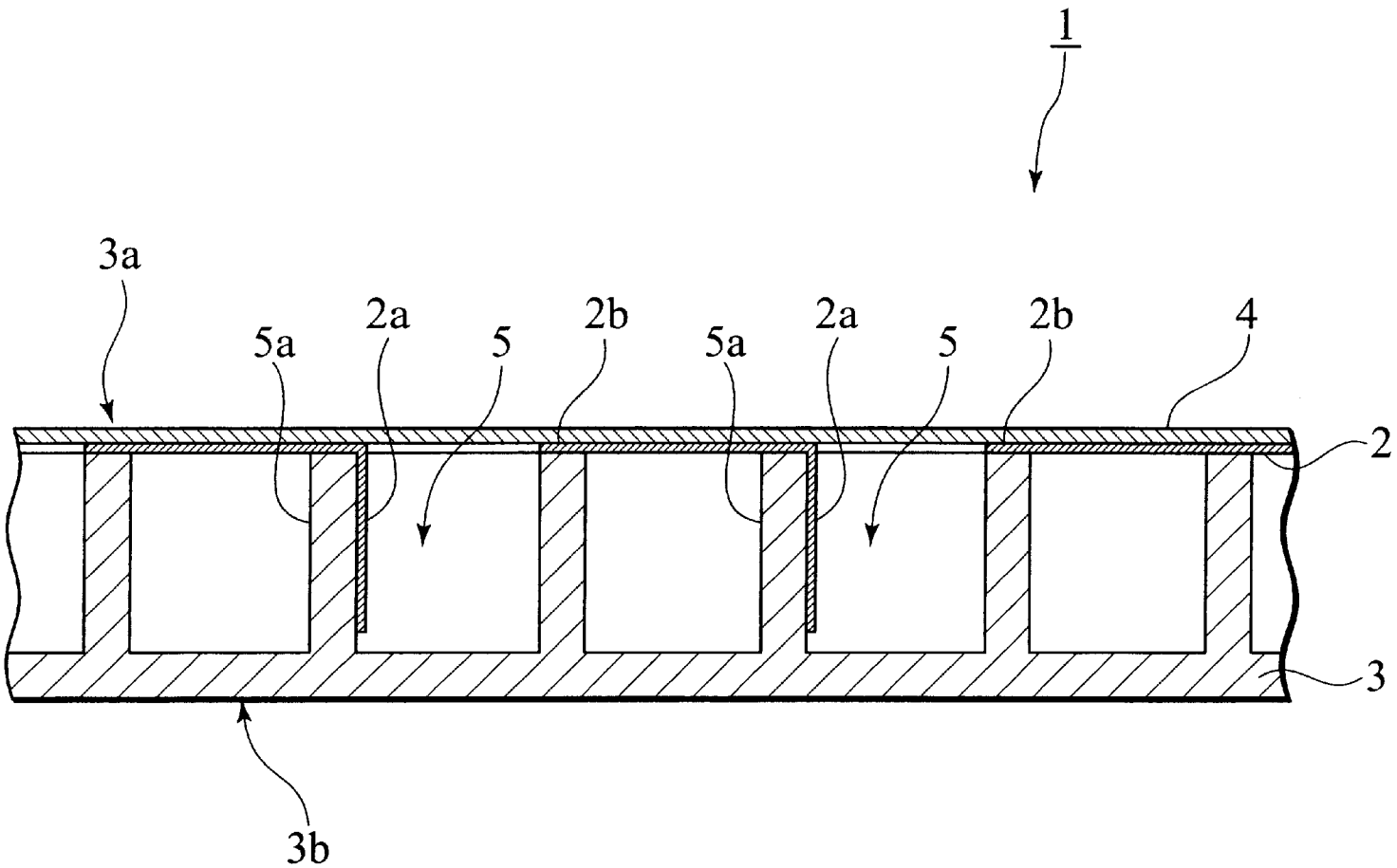
FIG. 2 is a sectional view showing an enlarged part of the image display medium.

One example of image display medium used in the present system is shown in FIGS. 1 and 2. An image display medium 1 of FIGS. 1 and 2 comprises a film body 2 composed of insulating film, intervening between a supporting member 3 and a cover member 4.

The film body 2 is made of resinous material, such as polyethylene terephthalate (PET), and is shaped to be a film having optional size and shape corresponding to a display screen image. Further, the film body 2 is provided, all over its surface, with a number of e.g. U-shaped notches at predetermined intervals. Defined by these notches are a number of microscopic film pieces 2*a* each of which has a light blocking effect. Further, an area between the adjoining microscopic film pieces 2*a* forms a base 2*b* of the film body 2.

The microscopic film pieces 2*a* of the film body 2 correspond to display pixels (picture elements) of the image display medium 1, respectively. For example, each film piece 2*a* is shaped to be a square, the order of 20–100 $\mu$m each side. As for the size of the microscopic film piece 2*a*, it may be properly determined corresponding to the application of the image display medium 1. For instance, when the image display medium 1 is used under a situation that it might be viewed at a distance, such as large-sized signboard, each microscopic film piece 2*a* may be formed to be a square more than 100 $\mu$m on a side. Additionally, the shape of the microscopic film piece 2*a* is not limited to only square. Thus, on consideration of easiness of forming, visibility, etc., the microscopic film piece 2*a* may have an optional configuration. Even then, the existing high-precision processing technology would meet such a requirement with ease. For example, the microscopic film pieces 2*a* can be provided by snicking the film body 2 by means of a shaping die having fine edges corresponding to the pieces 2*a*. Alternatively, the pieces 2*a* can be provided by snicking the film body 2 by using a laser cutting device.

In the above film body 2, the numerous microscopic film pieces 2*a* are rotatable against the base 2*b*, about respective fulcrums each formed by a boundary between the piece 2*a* and the base 2*b*. Abutting on a main face 3*a* of the supporting member 3, the base 2*b* of the film body 2 is also supported by the supporting member 3.

The supporting member 3 is formed by a plate of resinous material, such as PET, having a thickness providing a sufficient strength and appropriate flexibility for the image display medium 1. The supporting member 3 is provided, on the side of the main face 3*a*, with a number of receiving spaces 5 which correspond to the numerous microscopic film pieces 2*a* of the film body 2 respectively and which allow the microscopic film pieces 2*a* to be moved independently.

On the side of the main face 3*a* of the supporting member 3, namely, there are provided the receiving spaces 5 each of which is shaped to correspond to the microscopic film piece 2*a*. These receiving spaces 5 are arranged in positions directly under the numerous film pieces 2*a* while the supporting member 3 is supporting the film body 2. On the other hand, the base 2*b* of the film body 2 is arranged to abut on the upper ends of partitions 5*a* each separating the adjoining receiving spaces 5 from each other. Thus, the film body 2 is supported by the upper ends of the partitions 5*a*. With this arrangement, when each microscopic film piece 2*a* pivots about the boundary with the base 2*b* as a fulcrum, the microscopic film piece 2*a* moves in the receiving space 5 of the supporting member 3. Noted that the above supporting member 3 can be easily produced by first filling up a molding die having microscopic projections corresponding to the numerous receiving spaces 5 with molten resinous material and successively causing solidification of the above resinous material. Alternatively, the above supporting member 3 may be produced by first expanding a plate member having a number of notches to define the receiving spaces 5 by the so-expanded notches and secondly bonding a sheet member to the above plate member having such a honeycomb structure to form the bottom for the receiving spaces 5.

The cover member 4 is arranged on the main face 3*a* having the receiving spaces 5 of the supporting member 3 defined thereon, through the film body 2. The cover member 4 is formed by a sheet member of translucent resinous material, which have both shape and profile corresponding to the film body 2 and the supporting member 3. In the image display medium 1, the film body 2 is supported on the supporting member 3 while the body 2 is sandwiched between the cover member 4 and the supporting member 3.

In the above-constructed image display medium 1, respective electric charges of the supporting member 3 and the cover member 4 are both fixed for their electret. Consequently, static charges are produced on both surfaces of the supporting member 3 and the cover member 4, respectively.

The electret for the supporting member 3 and the cover member 4 can be accomplished by the following method, for example. That is, on condition of melting the resinous material forming the supporting member 3 and the cover member 4, an external field is impressed on the resinous material. Then, after the inside of the resinous material has been polarized due to the external field, the molten resinous material is solidified. Consequently, there is maintained a condition that the internal polarization is established in the solidified resinous material, producing the supporting member 3 and the cover member 4 on electret.

Since the electric charges of the supporting member 3 and the cover member 4 are fixed in their electret conditions, each of the numerous microscopic film pieces 2*a* of the film body 2 pinched between the supporting member 3 and the cover member 4 has small electrostatic potential energy at both positions of both sides of the partition 5*a* and the cover member 4 due to an electrostatic induction phenomenon by their electrostatic charges, thereby forming so-called "bistable multivibrator". Therefore, in the image display medium 1 of the invention, there are established one condition that each film piece 2*a* of the film body 2 is absorbed into the cover member 4 to block off light and another condition that each film piece 2*a* is absorbed into the partition 5*a* of the supporting member 3 to transmit light. The image display medium 1 is adapted so as to display an image by selectively switching each of the film pieces 2*a* between the above conditions.

Figure 3A:
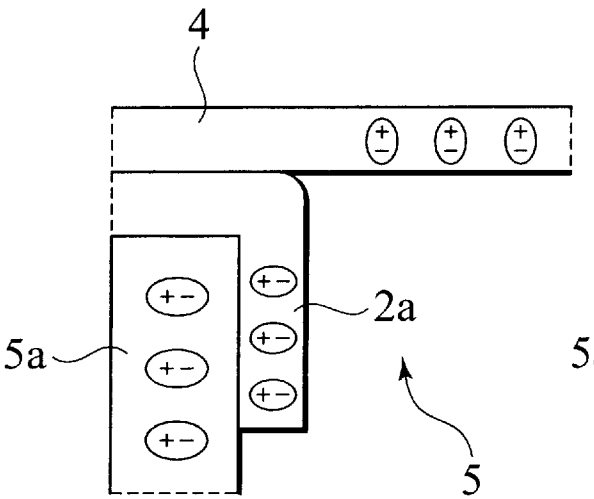

In detail, the resinous material forming the film body 2 is an electric insulating material (dielectric material). For example, as shown in FIG. 3A, when the microscopic film piece 2*a* comes into contact with the partition 5*a* of the supporting member 3, the film piece 2*a* of the film body 2 polarizes due to the electrostatic induction phenomenon by the electrostatic charges of the partition 5*a* of the supporting member 3, so that the resultant coulomb force causes the film piece 2*a* to be absorbed and held on the partition 5*a* of the supporting member 3. In this way, when the microscopic film piece 2*a* is absorbed into the partition 5*a* of the supporting member 3, incident light entering the image display medium 1 through the cover member 4 transmits the film body 2 without being interrupted by the microscopic film piece 2*a* having light blocking effect, so that a display pixel corresponding to the above microscopic film piece 2*a* is displayed in the form of a bright point.

Figure 3B:
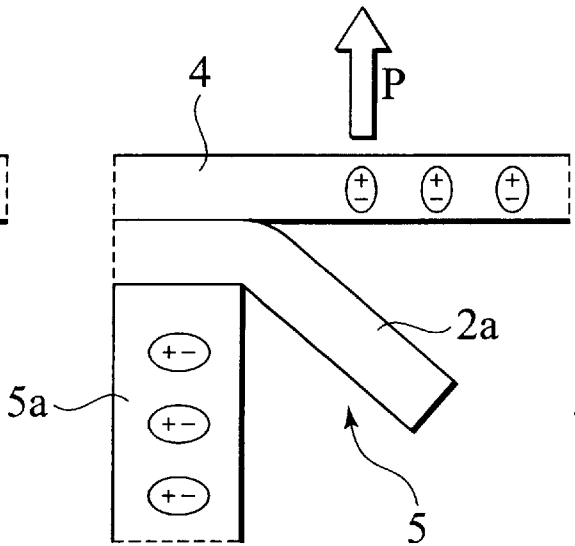

Here, as shown in FIG. 3B, when a strong sucking force P exceeding the holding force due to the electrostatic induction is applied on the cover member 4, the microscopic film piece 2*a* of the film body 2 is peeled from the partition 5*a* of the supporting member 3 owing to the action of the sucking force P to move in the receiving space 5 of the supporting member 3. Then, the microscopic film piece 2*a* moving in the receiving space 5 of the supporting member 3 is brought into electroneutral condition since the piece 2*a* is separated from the partition 5*a* of the supporting member 3.

Figure 3C:
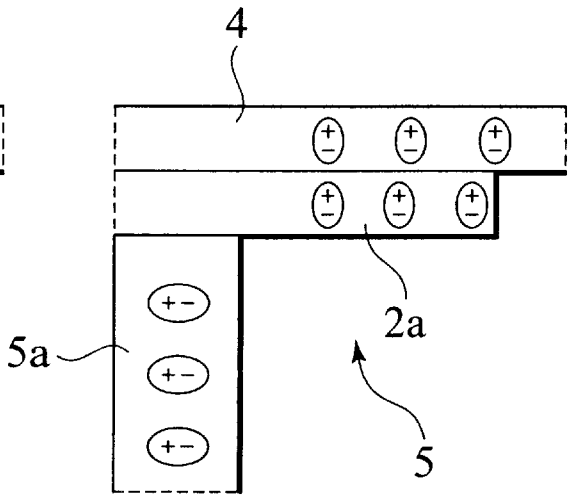

When the microscopic film piece 2*a* attracted by the sucking force P moves in the receiving space 5 of the supporting member 3 to approach the cover member 4, a polarization is caused in the film piece 2*a* due to an electrostatic induction phenomenon by the static charge of the cover member 4, so that the film piece 2*a* is absorbed by the cover member 4, as shown in FIG. 3C. In the state where the microscopic film piece 2*a* is absorbed by the cover member 4, an incident light entering the image display medium 1 through the cover member 4 is interrupted by the microscopic film piece 2*a*, so that a display pixel corresponding to the above microscopic film piece 2*a* is displayed in the form of a dark point.

In the image display medium 1, as mentioned above, there can be switched, for every microscopic film piece 2*a*, between one state that the microscopic film piece 2*a* of the film body 2 is absorbed by the cover member 4 to intercept light and another state that the microscopic film piece 2*a* is absorbed by the partition 5*a* of the supporting member 3 to penetrate the light, selectively. Consequently, the image display medium 1 is capable of displaying a desired image clearly while the brightness of the display pixels corresponding to the microscopic film pieces 2*a* is controlled respectively.

According to the image display medium 1, since there can be maintained a state that each microscopic film piece 2*a* of the film body 2 is absorbed by the cover member 4 or the partition 5*a* of the supporting member 3 unless a strong force exceeding a retaining force due to the electrostatic induction is applied from the outside, it is possible to maintain a state of displaying a desired image stably. Additionally, in the image display medium 1, since each of the microscopic film pieces 2*a* is selectively switched between light-insulating state and light transmittance state owing to the application of strong forces from the outside of the medium 1 corresponding to a desired display image, it is possible to carry out the rewriting of the display image repeatedly. Further, as the rewriting of the display image is realized by the movements of the microscopic film pieces 2*a*, it is possible to carry out the rewriting of the display image remarkably quickly and responsively.

The image display medium 1 of the invention is made from members (e.g. magnetic film, resinous molded part, etc.) standing on the previously-established manufacturing technique and is produced by the existing high-precision processing technology. Thus, it is possible to reduce the manufacturing cost.

Noted that each microscopic film piece 2*a* is in the form of a single film piece whose shape accords with the shape of the opening of each receiving space 5 of the supporting member 3 in the above-mentioned image display medium 1. In the modification, one microscopic film piece 2*a* may comprise a plurality of elementary film pieces 22, as shown in FIGS. 4 and 5.

Figure 4:
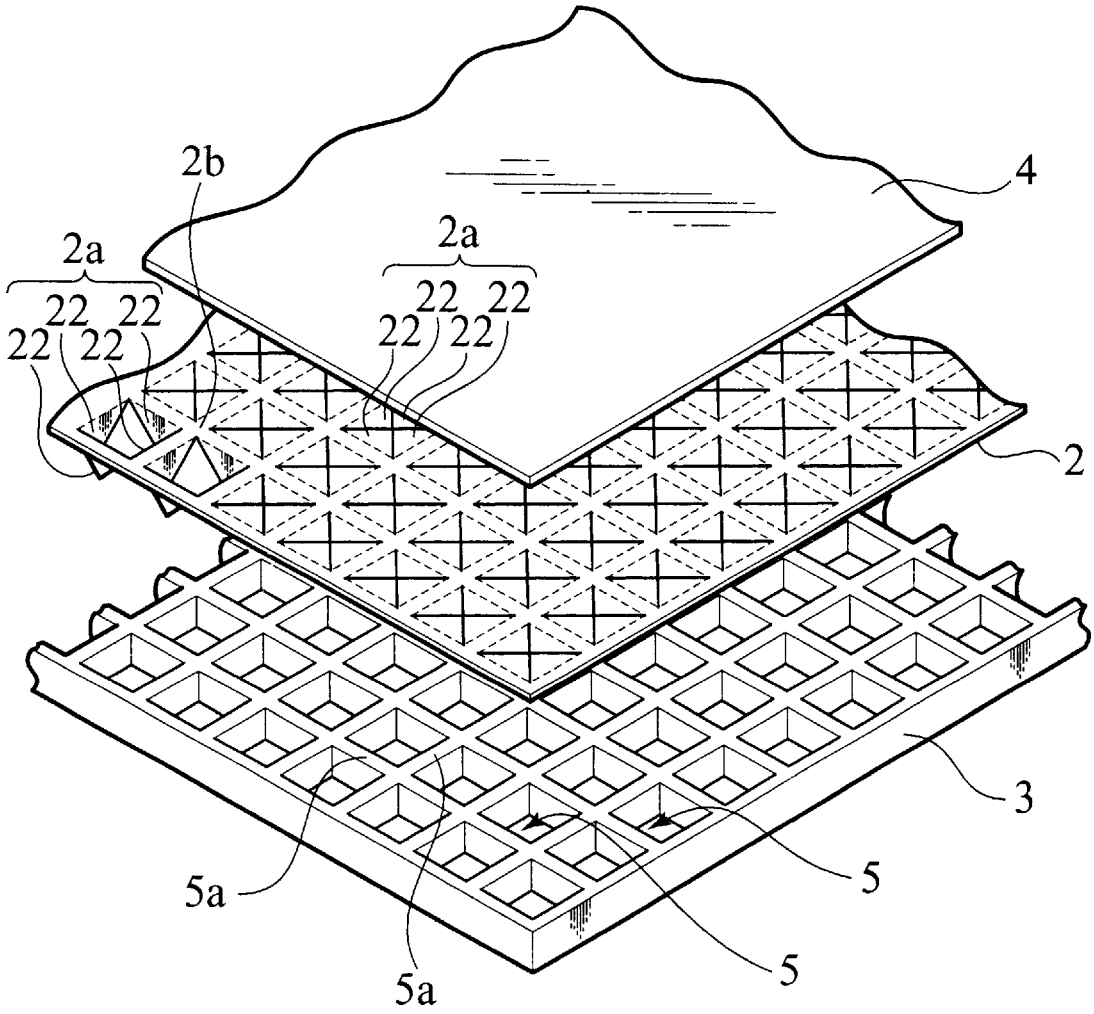
FIG. 4 is an exploded perspective view showing an enlarged part of another image display medium used in the image generating system on which the present invention is applied.

In a definite example of FIG. 4, for example, the film body 4 has a number of X-shaped notched formed all over the surface at regular intervals. Thus, the film body 2 has neighboring triangular portions each defined by the X-shaped notch (part) and one edge of the receiving space 5 of the supporting member 3, providing one elementary film piece 22. Corresponding to each receiving space 4, one microscopic film piece 2*a* consists of four elementary film pieces 22.

In the image display medium 1 constructed above, four elementary film pieces 22 forming one microscopic film piece 2*a* move in one receiving space 5 cooperatively. These elementary film pieces 22 are absorbed to either the cover member 4 or the partitions 5*a* of the supporting member 3, cooperatively. Consequently, it becomes possible to select either a state to block off light or another state to transmit light, each display pixel, whereby a desired image can be displayed on the image display medium 1.

Figure 5:
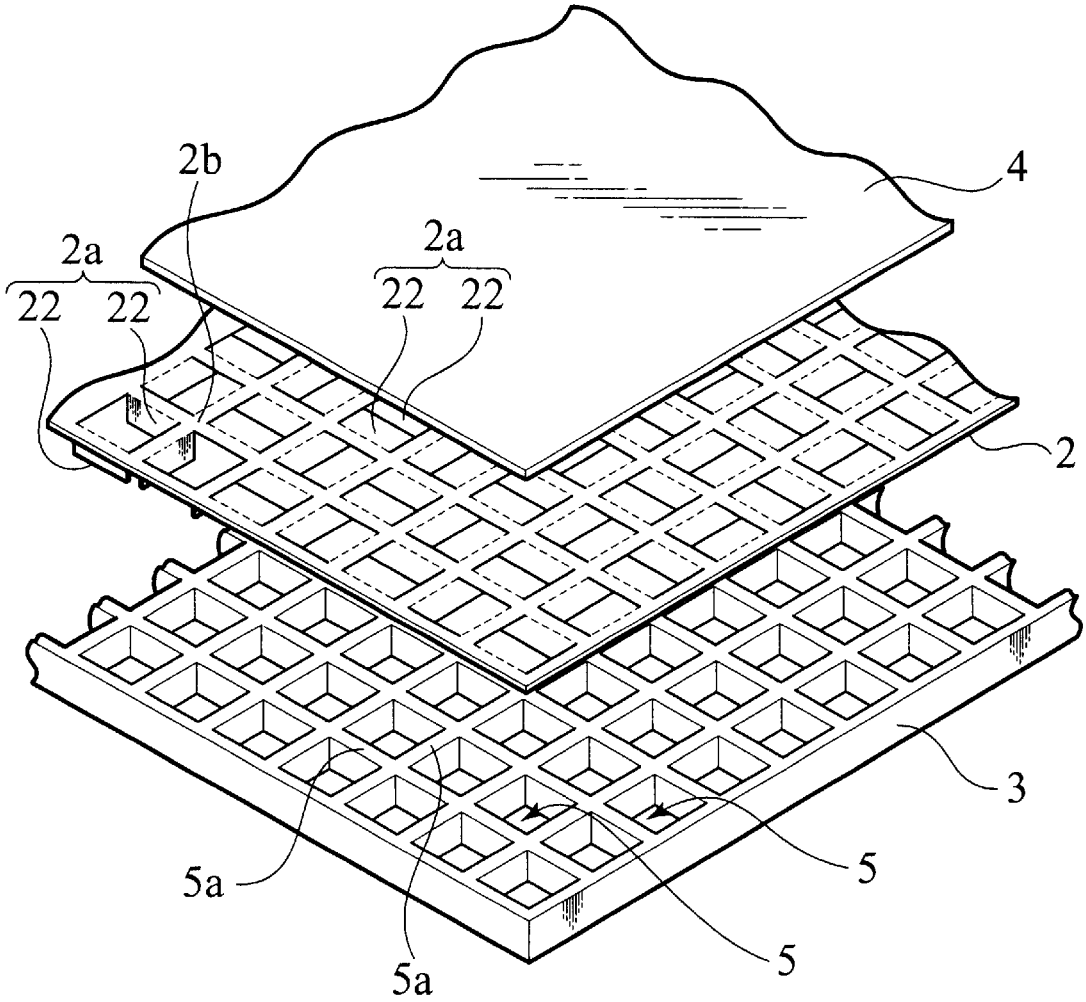
FIG. 5 is an exploded perspective view showing an enlarged part of a yet another image display medium used in the image generating system on which the present invention is applied.

In another example of FIG. 5, the film body 4 has a number of H-shaped notches formed all over the surface at regular intervals. Thus, the film body 2 has neighboring oblong portions each defined by the H-shaped notch (part) and one edge of the receiving space 5 of the supporting member 3, providing one elementary film piece 22. Corresponding to each receiving space 4, one microscopic film piece 2*a* consists of two elementary film pieces 22.

In the image display medium 1 constructed above, two elementary film pieces 22 forming one microscopic film piece 2*a* move in one receiving space 5 cooperatively. These elementary film pieces 22 are absorbed to either the cover member 4 or the partitions 5*a* of the supporting member 3, cooperatively. Consequently, it becomes possible to select either a state to block off light or another state to transmit light, each display pixel, whereby a desired image can be displayed on the image display medium 1.

In common with the above arrangements, since each microscopic film piece 2*a* is divided into plural elementary film pieces 22 and provided in the form of an aggregate of these elementary film pieces 22, it is possible to make the depth of each receiving space 5 of the member 3 shorter. It means that the thickness of the supporting member 3 can be reduced to produce a thin-model image display medium.

Noted that the image display medium of the invention is not limited to only the arrangements of FIGS. 4 and 5, in regard to the concept to divide each microscopic film piece 2*a* into plural elementary film pieces 22 and also the configuration of the resulting pieces 22. For example, it may be carried out to snick every microscopic film piece 2*a* at random so as to produce a plurality of elementary film pieces 22 shaped irregularly. As shown in FIGS. 4 and 5, however, when each microscopic film piece 2*a* is divided into plural elementary film pieces 22 through a parting line passing through the center of an opening of the receiving space 5 corresponding to the above piece 2*a*, it is possible to shorten the depth of the receiving space 5 by half of the depth of FIG. 1, allowing the whole image display medium 1 to be thinned most effectively.

Re. Image Generating Apparatus

Figure 6:
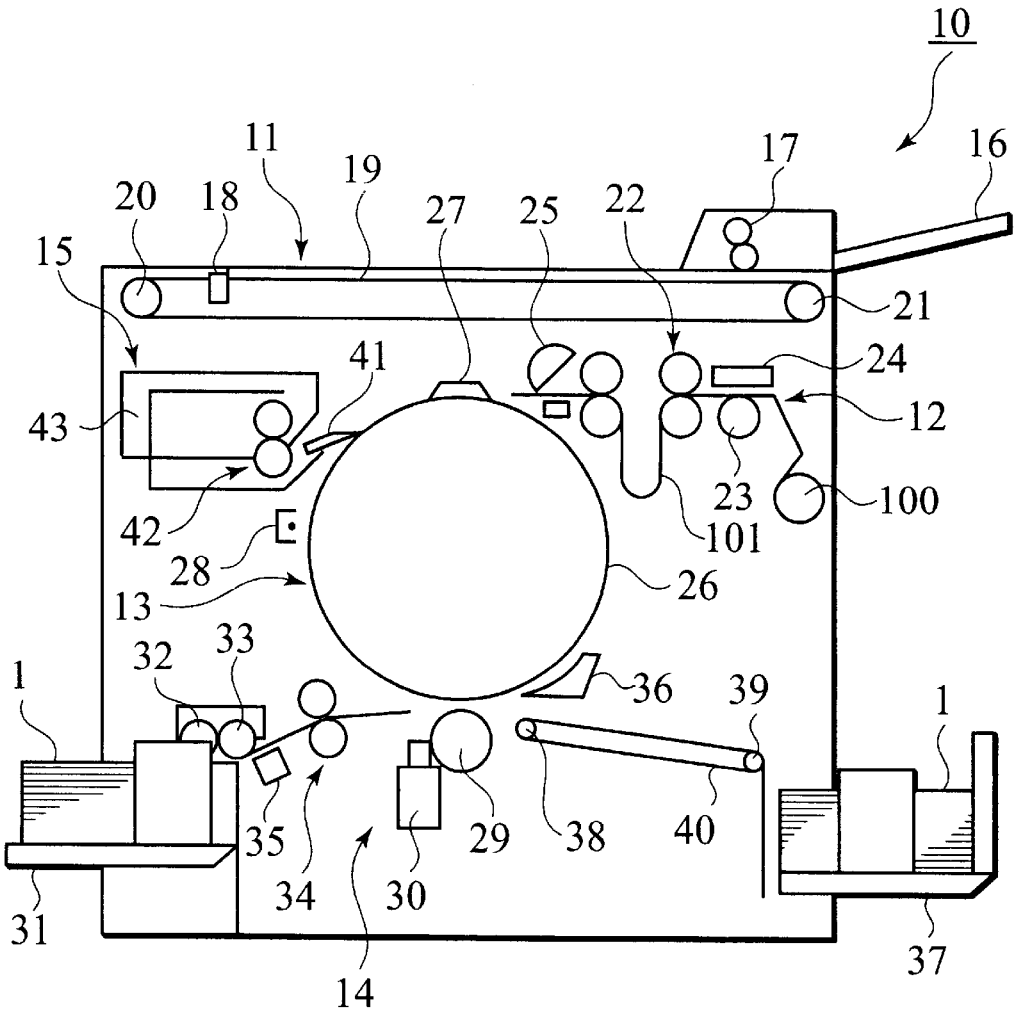
FIG. 6 is a schematic diagram showing the whole structure of an image generating apparatus used in the image generating system on which the present invention is applied.

Next, in the image generating system on the application of the invention, we describe an image generating apparatus for forming a desired display image on the above-mentioned image display medium 1 with reference to FIG. 6.

The image generating apparatus 10 as a result of the application of the existing stencil printing machine includes an image scan unit 11 for scanning a display image to be displayed on the medium 1 from a manuscript, a stencil processing unit 12 for forming a perforated image on a stencil paper 100 on the basis of data of the display image scanned by the image scan unit 11 thereby manufacturing a stencil sheet (master) 101, an image generating unit 13 that transcribes a perforated image in the stencil sheet 101 to the image display medium 1 thereby forming the display image in the image display medium 1, a transfer unit 14 for conveying the image display medium 1 and a stencil disposal unit 15 for junking the used stencil sheet 101.

In the image scan unit 11, a manuscript mounted on a manuscript mount 16 is transferred to a designated scanning position by a draft feeder 17. Then, a pictorial image (display image) of the manuscript at the scanning position is scanned by an image sensor 18.

The image sensor 18 is capable of scanning an open reading face of the manuscript by a shuttle unit having a belt 19 and pulleys 20, 21.

In the stencil processing unit 12, the stencil paper 100 stored in the form of a roll is drawn out by a paper feeder 22 and interposed between a platen roller 23 and a thermal head 24. The thermal head 24 is driven corresponding to the data of the display image scanned by the image scan unit 11. The thermal head 24 forms a perforated image on the stencil paper 100 to produce the stencil sheet 101. Then, the so-produced stencil sheet 101 is brought into the image generating unit 13 by a stencil sheet loading means (loader) 22. The end of the stencil sheet 101 is cut by a cutter 25.

Figure 7:
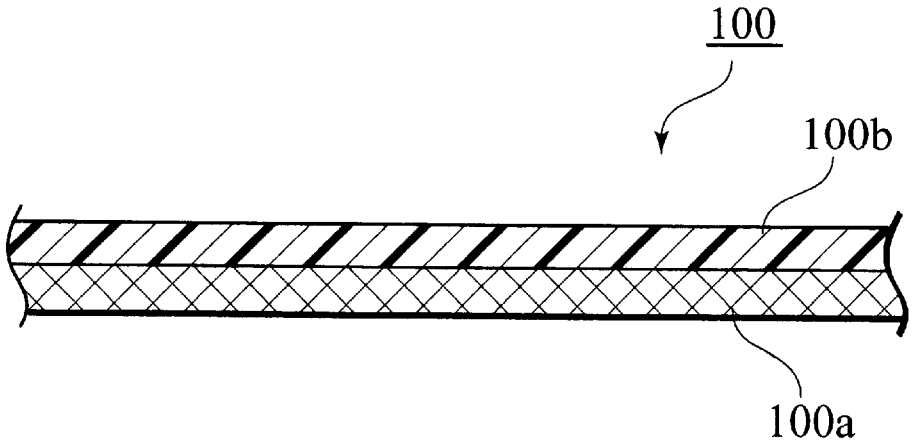
FIG. 7 is a sectional view showing one example of stencil sheet used by the image generating apparatus.

As the stencil paper 100 where a perforated image corresponding to the display image is formed by the stencil processing unit 12 of the apparatus 1, as shown in FIG. 7, there is preferably employed a paper 100 where a thermosensitive film 100*b* is laminated on a perforated carrier 100*a* coated with conductive agents.

In this stencil paper 100, the thermosensitive film 100*b* laminated on the perforated carrier 100*a* is perforated in melting or thermal-crush corresponding to the display image by the thermal head 24, forming a perforated image.

For the perforated carrier 100*a*, there may be optionally employed materials that have been generally used for this kind of stencil paper. For example, Japanese papers made from various kinds of fibers are available for the carrier 100*a*. For the above fibers, synthesized fiber (e.g. polyester fiber, vinylon fiber, nylon fiber, etc.,) and/or natural fiber (e.g. manila fiber, paper mulberry, mitsumata plant, pulp, etc.) are available independently or in the mixed form. The basic weight of the perforated carrier 100*a* normally ranges from 6 g/m$^2$ to 14 g/m$^2$, preferably, 7 to 13 g/m$^2$. Thickness of the perforated carrier 100*a* ranges from 20 $\mu$m to 60 $\mu$m, preferably, 25 to 50 $\mu$m.

As for the conductive agents to be coated on the perforated carrier 100*a*, polymer cationic conductor composed of copolymer is available. Such a polymer cationic conductor comes onto the market, in the name of "Elecond-50B" (article name) by Soken chemical & Engineering Co., Ltd.; "Chemistat 6300, 8800 and 5500" (article name) by Sanyo Chemical Industries, Ltd.; "Conductive Polymer C-280" (article name) by Calgon Carbon Corporation; "Gohsei Fimer C-760" (article name) by Nippon Synthetic Chemical Industry Co., Ltd., and so on.

Noted that the above conductive agents is water-soluble polymer electrolyte generally. Thus, it is feared that the perforated carrier 100*a* has cracks in the coating process to coat the conductive agents on the perforated carrier 100*a* of relatively-low basic weight or that the perforated carrier 100*a* has dry wrinkles in the drying process to dry the perforated carrier 100*a* coated with the conductive agents. Therefore, it is desirable to adopt, besides water, organic solvent, for example, alcohol, ketones and esters solvent as diluted solution for the conductive agents. That is, if diluting the conductivity treatment substance with the above organic solvent thereby forming the conductive agents and further coating the so-diluted conductive agents on the perforated carrier 100*a*, then it is possible to restrain the occurrence of drawbacks of notches and wrinkles in the carrier 100*a*.

Particularly desirable for the conductivity treatment substance for the conductive agents is well-known polymer cation-salt having a quaternary ammonium group, for example, polyvinyl benzil trimethyl, ammonium chloride, polydimethyl aryl ammonium chloride, poly N-methylvinyl pyridinium chloride. Besides, there may be used "ionic conductor" type conductive agents having the third amino group, sulfonium group or phosphonium group. Alternatively, polymer anion-salt having carboxyl group, sulfone group, sulfuric group, phosphoric group, etc. in the molecule may be used although its effect to give conductivity is inferior to the above polymer cation-salt. Further, the conductivity treatment substance mentioned above may be mixed or accompanied with binder or the other accessory ingredients.

For the thermosensitive film 100*b*, there may be optionally employed plastic film that has been generally used for this kind of stencil paper. For example, polyester film, PET film, polyvinyl chloride film, etc. are available for the film 100*b*. Particularly preferable for such a thermosensitive film 100*b* is a biaxial stretching film that has a thickness less than 10 $\mu$m, preferably, 1 to 5 $\mu$m.

Figure 8:
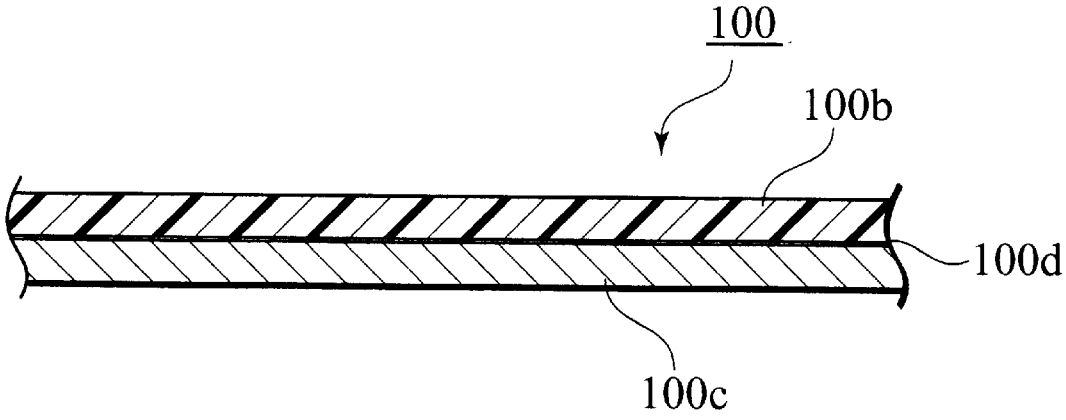
FIG. 8 is a sectional view showing another example of stencil sheet used by the image generating apparatus.

As for the structure of the stencil paper 100, as shown in FIG. 8, there may be adopted a paper 100 where the thermosensitive film 100*b* coheres on a conductive film 100*c* through a conductive wax 100*d*, besides the above-mentioned structure. Also in this stencil paper 100, the thermosensitive film 100*b* adhering to the conductive film 100*c* is molten and perforated corresponding to the display image by the thermal head 24, whereby a perforated image can be formed.

The image generating unit 13 includes a rotary drum 26 rotated by a not-shown motor. The outer circumferential face of the rotary drum 26 is covered with metallic material, such as nickel. The stencil sheet 101 (i.e. the stencil paper 100 having a perforated image formed therein) is wound around the outer circumferential face of the rotary drum 26. The stencil sheet 101 is attached to the outer circumferential face of the rotary drum 26 since a clamping unit 27 engages both ends of the sheet 101 with the drum 26.

A "corotron" 28 is provided to charge the stencil sheet 101 around the rotary drum 26. When the stencil sheet 101 is subjected to an electrical charge by the corotron 28, the thermosensitive film 100*b* of the stencil sheet 101 retains the electrical charge, while the electrical charge escapes toward the rotary drum 26 in the sheet's portions where the perforated carrier 100*a* is exposed due to the formation of the perforated image. Consequently, a charge-contrast corresponding to the perforated image is produced in the stencil sheet 101.

Below the rotary drum 26, a press roller 29 is rotatably arranged in parallel with the drum 26. The press roller 29 is movable closer to and away from the rotary drum 26 in a predetermined range and is adapted so as to pinch the image display medium 1 transferred from the transfer unit 14 between the rotary drum 26 and the roller itself. With the drive of a "pressure-changeable" motor 30, it is possible to adjust a pressure of the press roller 29 applied on the rotary drum 26. It is desirable to form the press roller 29 by conductive material. Then, it becomes possible to earth the apparatus through the press roller 29. That is, by setting unnecessary charges free via the press roller 29, it is possible to accomplish the image formation against the image display medium 1 and also its transportation smoothly.

In the transfer unit 14, a paper feed roller 32 and a paper jog roller 33 pick up the image display media 1 from a paper feed tray 31 one by one. The picked-up image display medium 1 is transferred to the image generating unit 13 by timing rollers 34 at predetermined intervals. In the feeding route of the image display medium 1, an eraser head 35 is arranged to erase a display image on the medium 1. The image display medium 1 is transferred to the image generating unit 13 after the medium 1 has been initialized by the eraser head 35.

In the transfer unit 14, the image display medium 1 having the display image formed by the image generating unit 13 is withdrawn from the rotary drum 26 by a medium separating claw 36. The so-withdrawn medium 1 is transferred to a sheet discharge tray 37 for disposal. A transfer conveyer comprises a pulley 38 at a transfer starting position, a pulley 39 at a transfer ending position, and an endless transfer belt 40 wound between the pulleys 38, 39. Since the rotations of the pulleys 38, 39 drive the endless transfer belt 40, the image display medium 1 on the belt 40 is transferred to the sheet discharge tray 37.

In the stencil disposal unit 15, the used stencil sheet 101 is separated from the rotary drum 26 by a sheet separating claw 41. Then, the used stencil sheet 101 is transferred by a stencil disposal roller 42 and accommodated in a stencil disposal box 43.

In case of generating a desired display image in the image display medium 1 by using the image generating apparatus 10, a manuscript is mounted on the manuscript mount 16 of the image scan unit 11, while the image display medium 1 is mounted on the paper feed tray 31 in the transfer unit 14. Next, the image scan unit 11 scans an image of the manuscript, so that the data of this image (display image) is supplied to the stencil processing unit 12.

When the data of the display image is brought into the stencil processing unit 12, the stencil paper 100 stored in the form of a roll is drawn out by the stencil sheet loading means 22 and further, the thermal head 24 is driven corresponding to the display image. Consequently, the thermosensitive film 100*b* of the so-drawn stencil paper 100 is melted and perforated corresponding to the display image, so that a perforated image is formed in the stencil paper 100.

The stencil paper 100 (the stencil sheet 101) having the perforated image formed therein is cut, at its end, by the cutter 25 and successively transferred to the rotary drum 26 of the image generating unit 13. Then, the stencil sheet 101 is attached to the outer circumferential face of the rotary drum 26 while the end of the sheet 101 is clamped by the damper 27.

The rotary drum 26 having the stencil sheet 101 attached thereto is rotated by the motor. With the rotation of the rotary drum 26, the stencil sheet 101 moves on the circumferential side of the drum 26. Then, the corotron 28 in the vicinity of the rotary drum 26 gives an electrical charge to the whole stencil sheet 101. When the stencil sheet 101 becomes charged by the corotron 28, the thermosensitive film 100*b* of the stencil sheet 101 retains the electrical charge, while the electrical charge escapes toward the rotary drum 26 in the sheet's portions where the perforated carrier 100*a* coated with conductive agents exposes as a result of forming a perforated image on the film 100*b*. Consequently, a contrast of electrical charge corresponding to the perforated image is produced in the stencil sheet 101.

On the other hand, the image display media 1 mounted on the paper feed tray 31 of the transfer unit 14 are taken out by the paper feed roller 32 and the paper jog roller 33, one by one. Then, the display image in the image display medium 1 is eliminated into its initialized state by the eraser head 35. In this description, there is defined a condition that all the microscopic film pieces 2*a* in the film body 2 are absorbed to the partitions 5*a* of the supporting member 3, as the initial state of the image display medium 1. The image display medium 1 in the initial state is supplied by the timing rollers 34 in exact timing with the rotation of the rotary drum 26.

The image display medium 1 transferred to the image generating unit 13 is pinched between the rotary drum 26 and the press roller 29. For a period of transferring the image display medium 1 with the rotations of the rotary drum 26 and the press roller 29, the perforated image in the stencil sheet 101 is transcribed to the medium 1, forming a display image therein.

In detail, since the stencil processing unit 12 forms a perforated image corresponding to the display image in the stencil sheet 101, there is produced a difference of electric resistance between the sheet's portion leaving the thermosensitive film 100*b* as an insulating material and the other sheet's portion where the thermosensitive film 100*b* is molten to expose the perforated carrier 100*a*. Next, when the corotron 28 applies an electrical charge on the whole stencil sheet 101 on the outer circumferential face of the rotary drum 26, the electrical charge is maintained in the sheet's portion leaving the thermosensitive film 100*b*, while the electrical charge is released in the other sheet's portion where the thermosensitive film 100*b* is molten to expose the perforated carrier 100*a*. In this way, the stencil sheet 101 has a contrast of electrical charge corresponding to the required display image.

Figure 9:
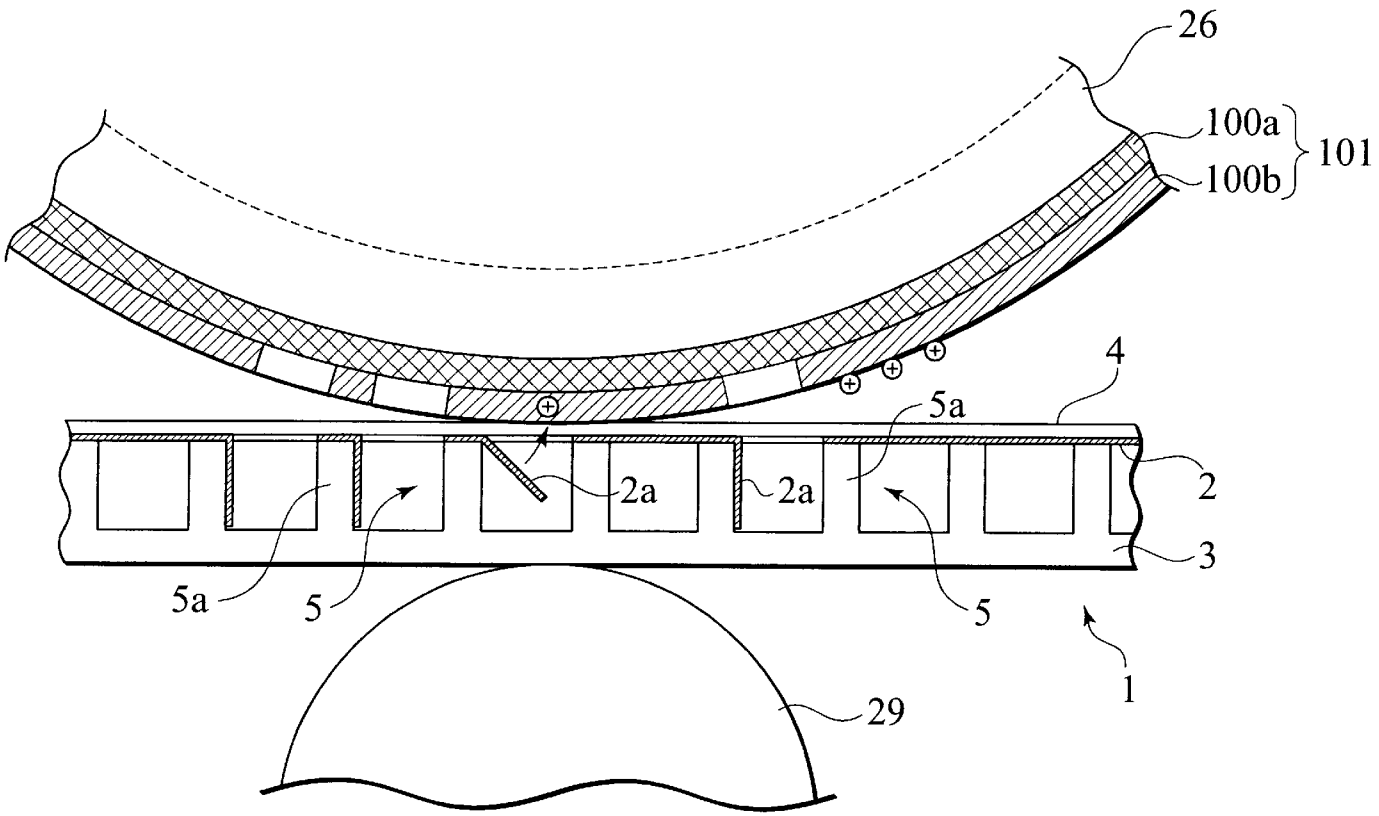
FIG. 9 is an enlarged view of a situation where an display image is generated on the image display medium by the image generating apparatus.

FIG. 9 is a view showing a condition that the image display medium 1 in the initial state (due to the eraser head 35) is brought into contact with the stencil sheet 101 completed in the above way. Then, in the medium's portion just under the stencil sheet's portion having a perforated image, that is, the sheet's portion where the thermosensitive film 100*b* is molten to expose the perforated carrier 100*a*, there is maintained a condition that the corresponding microscopic film pieces 2*a* are still absorbed to the partitions 5*a* of the supporting member 3. On the other hand, in the medium's portion just under the stencil sheet's portion leaving the thermosensitive film 100*b*, the microscopic film pieces 2*a* are peeled from the partitions 5*a* and attracted to the covering member 4 due to the action of the electrical charge of the thermosensitive film 100*b*.

As a result, the microscopic film pieces 2*a* of the film body 2 are selectively absorbed to either the partitions 5*a* of the supporting member 3 or the cover member 4 corresponding to the perforated image of the stencil sheet 101, so that an image corresponding to the perforated image of the stencil sheet 101, i.e. the display image is formed in the image display medium 1.

Then, the image display medium 1 having the required display image formed therein is separated from the rotary drum 26 by the medium separating claw 36 and transferred to the sheet discharge tray 37 by the transfer conveyer. The used stencil sheet 101 is separated from the rotary drum 26 by the sheet separating claw 41 and transferred into the stencil disposal box 43 by the stencil disposal roller 42.

As mentioned above, by using the image generating apparatus 10 on the application of a stencil printing machine, it is possible to generate a desired display image in the image display medium 1 appropriately and easily. Particularly, since the image generating apparatus 10 is capable of generating a display image in one image display medium 1 per rotation of the rotary drum 26 similarly to the stencil printing machine, it is possible to perform the generation of the display image for the image display medium 1 at remarkable high speed while taking advantage of the high-speed multicopy printing function of the stencil printing machine.

Thereinbefore, we described one example of the image generating apparatus used in the image generating system on the application of the invention in detail. So long as the image generating apparatus in the above system is constructed so as to suitably display a desired display image on the image display medium 1 on the application of the stencil printing technique, various changes and modifications may be made to the present invention without being limited to the above-mentioned example.

Notes that, in the above-mentioned image generating apparatus 10, the display image is formed in the image display medium 1 in accordance with the contrast of electrical charge provided by the corotron 28. That is, the microscopic film pieces 2*a* forming the medium 1 are selectively driven owing to the attractive force of the electrical charge.

In the modification, the microscopic film pieces 2*a* may be selectively driven by air pressure. In this case, for example, air pressure is applied from the rotary drum 26 to the image display medium 1 through the stencil sheet 101. Owing to the air pressure, the microscopic film pieces 2*a* are selectively moved in accordance with the perforated image of the stencil sheet 101. Consequently, as similar to the previous embodiment, it is possible to establish a condition where the microscopic film pieces 2*a* are absorbed to either the cover member 4 or the partitions 5*a* of the supporting member 3, forming the desired display image in the image display medium 1.

Figure 10:
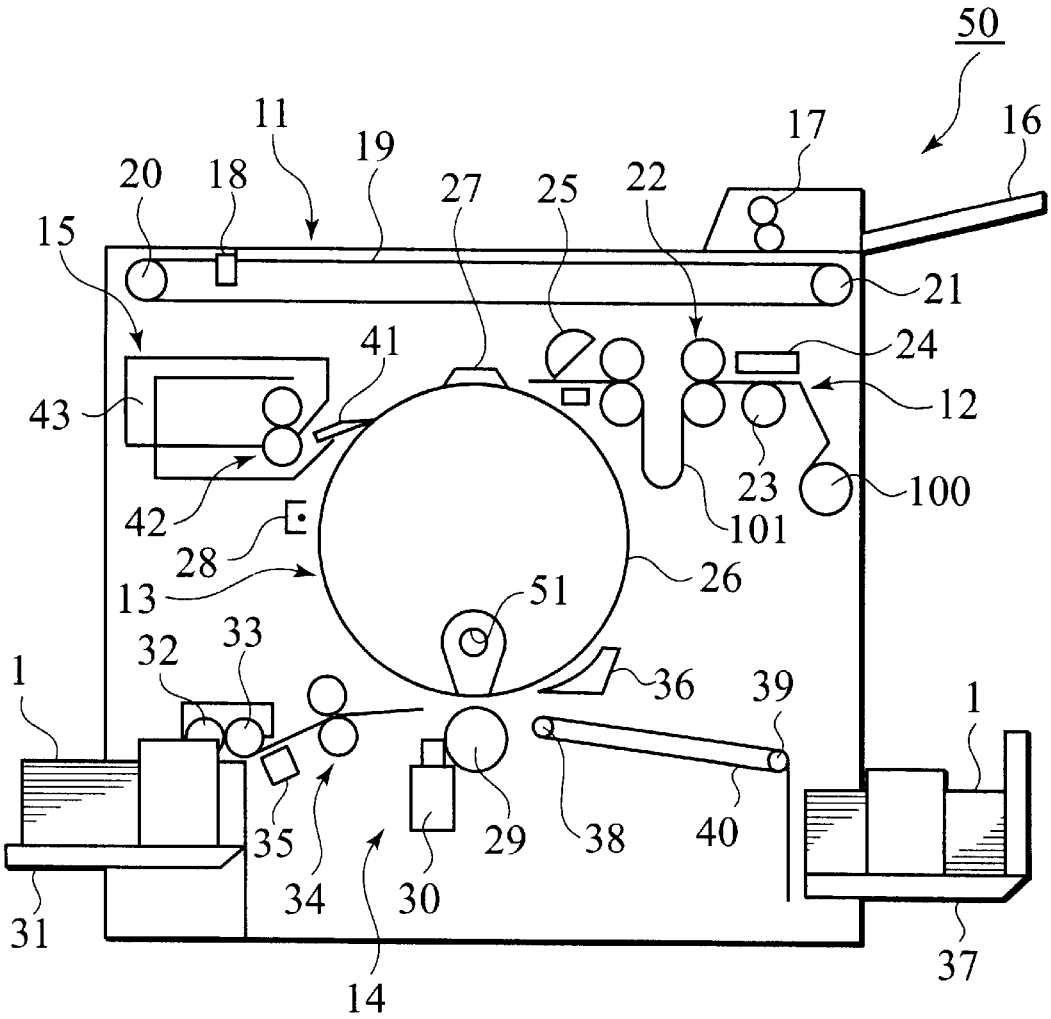
FIG. 10 is a schematic diagram showing the whole structure of another image generating apparatus used in the image generating system on which the present invention is applied.
Figure 11:
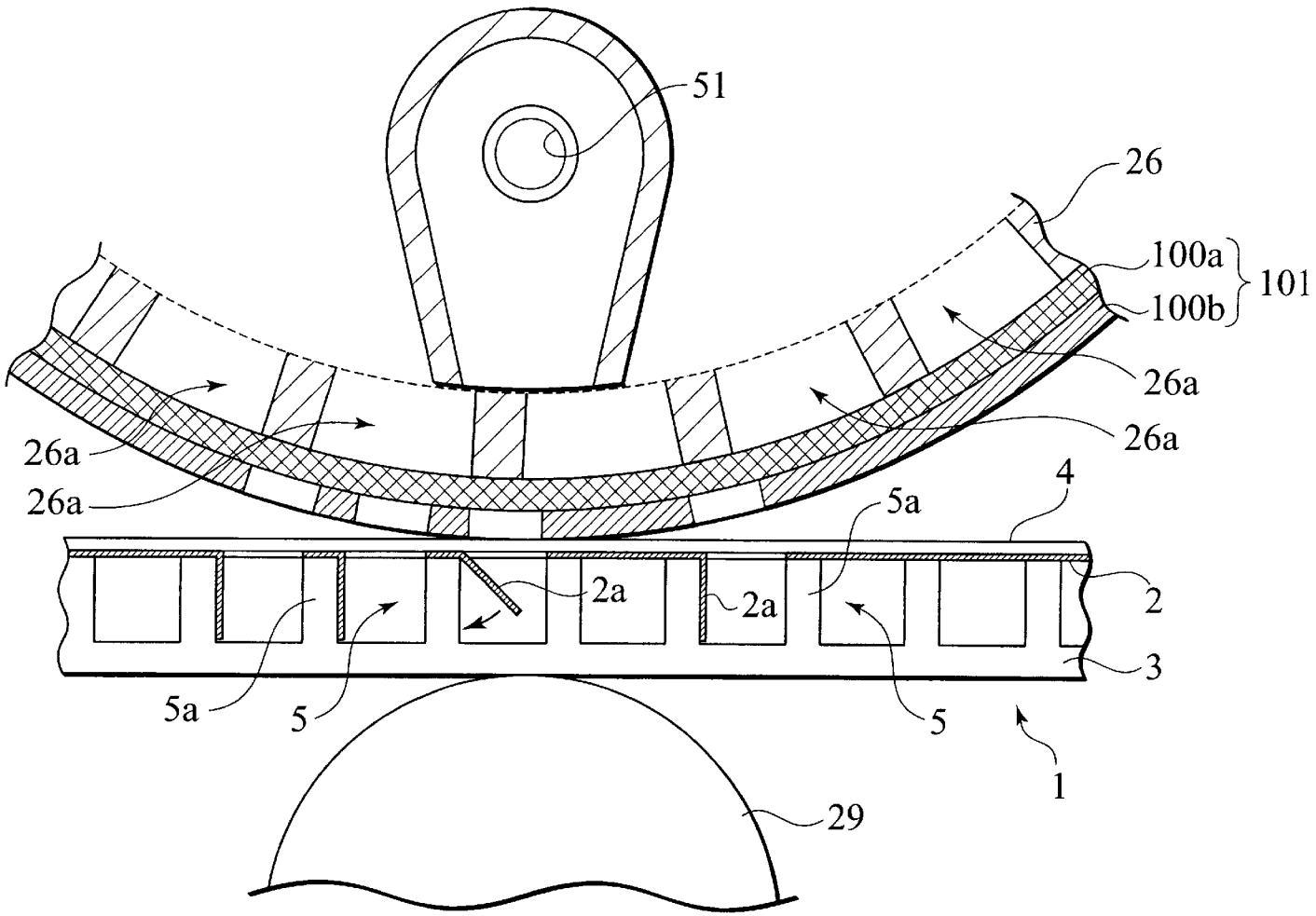
FIG. 11 is an enlarged view of a situation where an display image is generated on the image display medium by the other image generating apparatus.

The above-constructed image generating apparatus will be described with reference to FIGS. 10 and 11. Except for the fact that the image generating unit 13 forms a display image in the image display medium 1 in the above way, the image generating apparatus 50 of the figures is similar to the image generating apparatus 10 in terms of constitution. Therefore, elements similar to those of the image generating apparatus 10 are indicated with the same reference numerals respectively and their overlapping descriptions are eliminated.

The image generating apparatus 50 is provided, inside the rotary drum 26, with a not-shown air supply mechanism that supplies an air discharge pipe 51 with air. The air from the air supply mechanism is discharged from the air discharge pipe 51 toward the outer circumferential side of the rotary drum 26. On the outer circumferential part of the rotary drum 26, which part is made from metallic material, ventilation gaps 26*a* are formed over the whole surface of the outer circumferential part, for passage of the air discharged from the pipe 51. The stencil paper 100 (the stencil sheet 101) is attached to the outer circumferential face of the rotary drum 26 provided with the gaps 26*a*. Of course, the image generating apparatus 50 is not provided with the corotron 28 of the previous image generating apparatus 10.

As the stencil paper 100 forming the stencil sheet 101, the thermosensitive film 100*b* is laminated on the perforated carrier 100*a* having no conductive agents coated thereon. Since the perforated image in the thermosensitive film 100*b* is transcribed to the image display 1 by air pressure, the perforated carrier 100*a* is required to have sufficient air permeability. There is no need to provide the perforated carrier 100*a* with conductivity. Therefore, the image generating apparatus 50 employs the stencil paper 100 where the thermosensitive film 100*b* is laminated on the above-mentioned perforated carrier 100*a* composed of Japanese paper or the like. This stencil paper 100 is similar to a stencil paper normally used in the stencil printing machine.

Further, the cover member 4 having air permeability is used as the image display medium 1 in the image generating apparatus 50. In the image display medium 1, air discharged from the air discharge pipe 51 is introduced into the receiving spaces 5 of the supporting member 3 through the cover member 4. It is desirable that the image display medium 1 has air permeability at the bottom part of the supporting member 3. Then, since the bottom part of the supporting member 3 allows air introduced into the receiving spaces 5 to be discharged out of the medium 1, it is possible to prevent pressures in the receiving spaces 5 from increasing excessively.

The application of air permeability on the cover member 4 and the supporting member 3 can be easily accomplished by first processing a sheet-shaped resinous material with a diamond roller etc. thereby forming a number of fine holes in the resinous material and second forming the bottoms of the cover member 4 and the supporting member 3 by using the resinous material having a number of fine hole.

It is also desirable that the image generating apparatus 50 has air permeability in the press roller 29 that pinches the medium 1 together with the rotary drum 26. Then, it is possible to dissolve a problem that the press roller 29 obstructs air discharged from the bottom part of the supporting member 3 to the outside of the receiving spaces 5.

In order to generate a desired display image in the image display medium 1 by using the image generating apparatus 50, the image scan unit 11 scans a manuscript image (display image), similarly to the case of the image generating apparatus 10.

Next, by the thermal head 24, the thermosensitive film 100*b* of the so-drawn stencil paper 100 is melted and perforated corresponding to the display image, so that a perforated image corresponding to the display image is formed in the stencil paper 100. Then, the stencil paper 100 (the stencil sheet 101) having the perforated image formed therein is attached to the outer circumferential face of the rotary drum 26 of the image generating unit 13.

Further, by the transfer unit 14, the image display media 1 are loaded into the image generating unit 13 in synchronous timing with the rotation of the rotary drum 26. During the transportation of the media 1 to the unit 13, the display image in each image display medium 1 is eliminated into its initialized state by the eraser head 35. In this description, there is defined a condition that all the microscopic film pieces 2*a* in the film body 2 are absorbed to the cover member 4 of the supporting member 3, as the initial state of the image display medium 1.

The image display medium 1 loaded into the image generating unit 13 is pinched between the rotary drum 26 and the press roller 29. For a period of transferring the image display medium 1 with the rotations of the rotary drum 26 and the press roller 29, the perforated image in the stencil sheet 101 is transcribed to the medium 1, forming a display image therein.

In detail, the stencil sheet 101 has the perforated image formed due to the melting of the thermosensitive film 100*b* corresponding to the display image. Thus, there are produced a sheet's portion where the thermosensitive film 100*b* is molten to expose the perforated carrier 100*a* and the other sheet's portion where the perforated carrier 100*a* is covered with the remaining thermosensitive film 100*b*.

When the stencil sheet 101 is attached to the outer circumferential face of the rotary drum 26 and the air discharge pipe 51 in the drum 26 feeds air toward the outer circumferential side of the drum 26, the air is discharged to the outside of the drum 26 through the stencil sheet 101. Then, when the image display medium 1 in the initial state due to the eraser head 35 comes into contact with the stencil sheet 101 attached to the drum 26, the flowing of air is blocked just under the sheet's portion where the thermosensitive film 100*b* remains, so that the microscopic film pieces 2*a* included in this portion stay as they were. That is, the microscopic film pieces 2*a* are absorbed to the cover member 4 without being subjected to air pressure from the drum 26.

While, just under the sheet's portion where the thermosensitive film 100*b* of the stencil sheet 101 is molten to expose the perforated carrier 100*a*, the air from the rotary drum 26 passes through the stencil sheet 101 without being blocked up by the thermosensitive film 100*b*. Therefore, the microscopic film pieces 2*a* included in this portion are subjected to the air pressure from the drum 26 and peeled from the cover member 4. As a result, the microscopic film pieces 2*a* move in the receiving spaces 5 and are absorbed to the partitions 5*a*.

In this way, the microscopic film pieces 2*a* of the film body 2 are selectively absorbed to either the partitions 5*a* of the supporting member 3 or the cover member 4 corresponding to the perforated image of the stencil sheet 101, whereby an image corresponding to the perforated image of the stencil sheet 101, i.e. the display image can be formed in the image display medium 1.

As mentioned above, according to the image generating apparatus 50, it is possible to generate a desired display image in the image display medium 1 appropriately and easily, as similar to the previously-mentioned apparatus 10. Additionally, taking advantage of the high-speed multicopy printing function of the stencil printing machine, it is possible to perform the generation of the display image for the image display medium 1 at remarkable high speed.

In connection with the above-mentioned embodiment, various changes and modifications may be made. Notes that, in the above-mentioned image generating apparatus 50, the display image is formed in the image display medium 1 by the action of air pressure applied on the medium 1 through the stencil sheet 101. In the modification, the air supply mechanism of the embodiment may be replaced by an air suction mechanism in the rotary drum 26. Then, the display image is formed in the image display medium 1 owing to the pressure of suction air applied on the medium 1 through the stencil sheet 101. Noted that, in the initial state of the image display medium 1, all the microscopic film pieces 2*a* of the film body 2 are absorbed to the partitions 5*a* of the supporting member 3. Just under the sheet's portion where the thermosensitive film 100*b* remains, the microscopic film pieces 2*a* included in this portion stay as they were. That is, the microscopic film pieces 2*a* are absorbed to partitions 5*a* of the supporting member 3. On the other hand, just under the sheet's portion where the thermosensitive film 100*b* of the stencil sheet 101 is molten to expose the perforated carrier 100*a*, the microscopic film pieces 2*a* in this portion are subjected to the pressure of air sucked into the drum 26 and peeled from the partitions 5*a*. As a result, the microscopic film pieces 2*a* move in the receiving spaces 5 and are absorbed to the cover member 4.

Finally, it will be understood by those skilled in the art that the foregoing description are preferred embodiments of the disclosed image generating apparatus and method. Various changes and modifications may be made to the present invention without departing from the spirit and scope of the invention.

What is claimed is:

1. An image generating method of generating a desired display image in a rewritable image display medium by transcribing a perforated image of a stencil sheet to the image display medium, the stencil sheet being attached to a rotary drum, the method comprising the steps of:

preparing the image display medium including:

a film body having a base and a number of microscopic film pieces connected with each other through the base, the microscopic film pieces having light-blocking effect and corresponding to respective pixels forming the desired display image;

a supporting member having a main face formed to support the film body thereon, the supporting member being provided, on the side of the main face, with a number of receiving spaces defined by partitions, the receiving spaces corresponding to the microscopic film pieces respectively and also allowing the microscopic film pieces to be moved therein independently; and a cover member arranged on the main face of the supporting member while interposing the film body therebetween, the cover member having light-transmitting effect, and allowing the microscopic film pieces of the film body of the image display medium to be selectively absorbed to either the cover member or the partitions by an electrostatic induction in accordance with the perforated image of the stencil sheet, thereby generating the display image in the image display medium.

2. An image generating method as claimed in claim 1, wherein the step of allowing the microscopic film pieces of the film body of the image display medium to be selectively absorbed, comprises the steps of:

allowing the stencil sheet attached to the rotary drum to take an electrical charge so that the stencil sheet produces a contrast of charge corresponding to the perforated image; and making the microscopic film pieces of the film body move in accordance with the contrast of charge to allow the microscopic film pieces to be selectively absorbed to either the cover member or the partitions, thereby generating the display image in the image display medium.

3. An image generating method as claimed in claim 2, further comprising the steps of:

preparing a stencil paper where a thermosensitive film is laminated on a perforated carrier coated with conductive agents; and forming the perforated image corresponding to the display image in the thermosensitive film thereby producing the stencil sheet.

4. An image generating method as claimed in claim 2, further comprising the steps of:

preparing a stencil paper where a thermosensitive film comes in close contact with a conductive film through a wax having conductivity; and forming the perforated image corresponding to the display image in the thermosensitive film thereby producing the stencil sheet.

5. An image generating method as claimed in claim 1, wherein the step of allowing the microscopic film pieces of the film body of the image display medium to be selectively absorbed, comprises the steps of:

emitting or sucking air through the rotary drum; and making the microscopic film pieces of the film body move in accordance with the perforated image of the stencil sheet by making use of air pressure of the air through the rotary drum to allow the microscopic film pieces be selectively absorbed to either the cover member or the partitions, thereby generating the display image in the image display medium.

6. An image generating apparatus for generating a desired display image in a rewritable image display medium, comprising:

medium loading means for transferring an image display medium, the image display medium having:

a film body having a base and a number of microscopic film pieces connected with each other through the base, the microscopic film pieces having light-blocking effect and corresponding to respective pixels forming the desired display image;

a supporting member having a main face formed to support the film body thereon, the supporting member being provided, on the side of the main face, with a number of receiving spaces defined by partitions, the receiving spaces corresponding to the microscopic film pieces respectively and also allowing the microscopic film pieces to be moved therein independently; and a cover member arranged on the main face of the supporting member while interposing the film body therebetween, the cover member having light-transmitting effect; and image generating means for generating the display image, the image generating means including a rotary drum having a stencil sheet attached thereto and also transcribing a perforated image of the stencil sheet attached to the rotary drum to the image display medium transferred by the medium loading means; wherein the image generating means is adapted to allow the microscopic film pieces of the film body of the image display medium to be selectively absorbed to either the cover member or the partitions in accordance with the perforated image of the stencil sheet, thereby generating the display image in the image display medium.

7. An image generating apparatus as claimed in claim 6, wherein the image generating means is adapted so as to allow the stencil sheet attached to the rotary drum to take an electrical charge so that the stencil sheet produces a contrast of charge corresponding to the perforated image and also adapted to make the microscopic film pieces of the film body move in accordance with the contrast of charge so that the microscopic film pieces are selectively absorbed to either the cover member or the partitions, thereby generating the display image in the image display medium.

8. An image generating apparatus as claimed in claim 6, wherein the image generating means is adapted to emit or suck air through the rotary drum and also adapted to make the microscopic film pieces of the film body move in accordance with the perforated image of the stencil sheet by making use of air pressure of the air through the rotary drum so that the microscopic film pieces are selectively absorbed to either the cover member or the partitions, thereby generating the display image in the image display medium.

* * * * *